US011033085B1

(12) United States Patent
Chen et al.

(10) Patent No.: US 11,033,085 B1
(45) Date of Patent: Jun. 15, 2021

(54) DETACHABLE SUNSHADE UMBRELLA RIB

(71) Applicant: NINGBO TUOZE ELECTRONIC TECHNOLOGY CO., LTD, Ningbo (CN)

(72) Inventors: Liming Chen, Suizhou (CN); Fu Zheng, Linhai (CN)

(73) Assignee: NINGBO TUOZE ELECTRONIC TECHNOLOGY CO., LTD, Ningbo (CN)

( * ) Notice: Subject to any disclaimer, the term of this patent is extended or adjusted under 35 U.S.C. 154(b) by 0 days.

(21) Appl. No.: 17/114,519

(22) Filed: Dec. 8, 2020

(30) Foreign Application Priority Data

Jul. 8, 2020 (CN) ..... 202021331240.7

(51) Int. Cl.
*A45B 19/06* (2006.01)
*A45B 23/00* (2006.01)
*A45B 19/10* (2006.01)

(52) U.S. Cl.
CPC ..... *A45B 19/06* (2013.01); *A45B 19/10* (2013.01); *A45B 23/00* (2013.01)

(58) Field of Classification Search
CPC ..... A45B 19/06; A45B 25/02; E04H 15/24; E04H 15/28; E04H 15/60
USPC ..... 135/25.1, 74, 75
See application file for complete search history.

(56) References Cited

U.S. PATENT DOCUMENTS 540,098 A * 5/1895 Grove et al. ..... A45B 25/02 135/31
880,427 A * 2/1908 Thedorf ..... A45B 19/06 135/26
920,400 A * 5/1909 Schutte ..... A45B 19/06 135/26
1,205,809 A * 11/1916 Steele ..... A45B 19/06 135/26
1,304,016 A * 5/1919 Bott ..... A45B 19/06 135/26
1,659,738 A * 2/1928 Knapp ..... A45B 19/06 135/26
1,691,411 A * 11/1928 Roth ..... E04H 15/44 135/114
2,546,157 A * 3/1951 Hume ..... F16B 7/1427 403/351
4,637,415 A * 1/1987 Dalo ..... E04H 15/28 135/20.3
2014/0251400 A1* 9/2014 Jin ..... E04H 15/46 135/120.3

FOREIGN PATENT DOCUMENTS

EP 2614746 A1 * 7/2013 ..... A45B 11/00

* cited by examiner

*Primary Examiner* — Noah Chandler Hawk

(57) ABSTRACT

The detachable sunshade umbrella rib includes a first umbrella rib and a second umbrella rib. The first umbrella rib is connected with the second umbrella rib by a sleeve connecting mechanism. The sleeve connecting mechanism includes a clamping hole, a sheath, and an elastic piece. The sheath is disposed on one end of the first umbrella rib. The clamping hole is on the first umbrella rib and is located on one side of the sheath. The elastic piece is disposed on the second umbrella rib; the second umbrella rib is sleeved into the first umbrella rib. The second umbrella rib is fixed with the first umbrella rib through the sheath, the elastic piece, and the clamping hole.

5 Claims, 4 Drawing Sheets

DETACHABLE SUNSHADE UMBRELLA RIB

TECHNICAL FIELD

The present disclosure relates to a field of disassembling and assembling components of a sunshade umbrella, in particular to a detachable sunshade umbrella rib.

BACKGROUND

A sunshade umbrella is generally used for outdoor sunshade and shelter from rain. The sunshade umbrella is relatively large and a sunshade umbrella rib is long, which occupy a huge logistical space and has high logistics costs. Due to the high logistics cost, reducing the transportation volume of the sunshade umbrella is an urgent problem in the umbrella industry. In addition, the sunshade umbrella rib is too long, which is easy to break when used in strong wind.

SUMMARY

In view of above-mentioned problems in the prior art, a purpose of the present disclosure is to provide a detachable sunshade umbrella rib.

The detachable sunshade umbrella rib comprises a first umbrella rib and a second umbrella rib.

The first umbrella rib is connected with the second umbrella rib by a sleeve connecting mechanism. The sleeve connecting mechanism comprises a clamping hole, a sheath, and an elastic piece. The sheath is disposed on one end of the first umbrella rib. The clamping hole is on the first umbrella rib and is located on one side of the sheath. The elastic piece is disposed on the second umbrella rib. The second umbrella rib is sleeved into the first umbrella rib. The second umbrella rib is fixed with the first umbrella rib through the sheath, the elastic piece, and the clamping hole.

Furthermore, one end of the second umbrella rib inserts into the first umbrella rib. Another end of the second umbrella rib is sleeved and fixed with a plug.

Furthermore, the elastic piece has a rounded structure. A side length of one side of the elastic piece that first runs through the first umbrella rib is less than a side length of another side of the elastic piece that runs through the first umbrella rib later.

Furthermore, another end of the first umbrella rib is fixedly connected with an umbrella plate. One end of the plug of the second umbrella rib is fixed with an umbrella cloth.

Furthermore, the sheath comprises a first sub sheath and a second sub sheath. The first sub sheath and the second sub sheath are integrally formed. An aperture of the first sub sheath is greater than an aperture of the second sub sheath. An inner surface of the first sub sheath of the sheath is frictionally connected with an outer surface of the first umbrella rib. An inner surface of second sub sheath of the sheath is slidingly sleeved with an outer surface of the second umbrella rib.

Furthermore, an outer diameter of the second sub sheath of the sheath is same as an outer diameter of the plug.

Furthermore, an end face of the plug extends and protrudes along the outer diameter of the plug to from a seat ring.

Compared with the prior art, the sunshade umbrella rib of the present disclosure is divided into two and is switched freely. Therefore, under a same logistical space limitation, more sunshade umbrella ribs are held and a cost is saved. The elastic piece of the sunshade umbrella rib is easy to rebound. For example, when the sunshade umbrella rib falls to the ground and receives a certain force, it triggers the elastic piece to rebound, effectively protecting the sunshade umbrella rib from being broken.

1—first umbrella rib; 2—sheath; 3—elastic piece; 4—second umbrella rib; 5—plug; 6—seat ring; 7—clamping hole; 21—first sub sheath; and 22—second sub sheath.

DETAILED DESCRIPTION

The following is a further explanation of the present disclosure in conjunction with the drawings.

Figure 1:
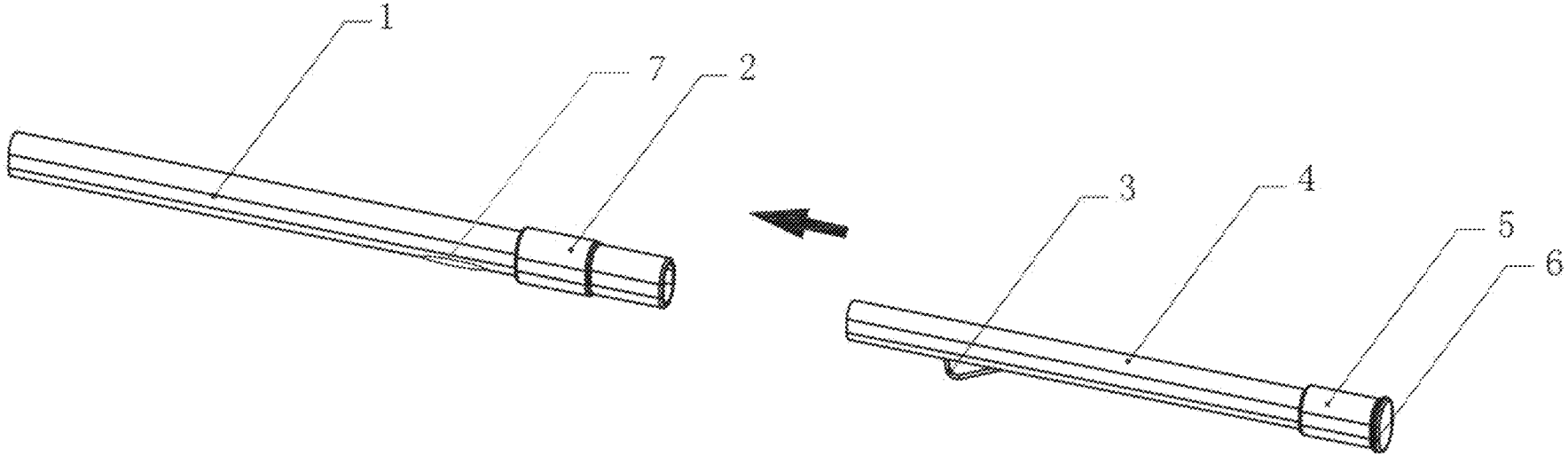
FIG. 1 is an exploded view of a sunshade umbrella rib according to one embodiment of the present disclosure.
Figure 2:
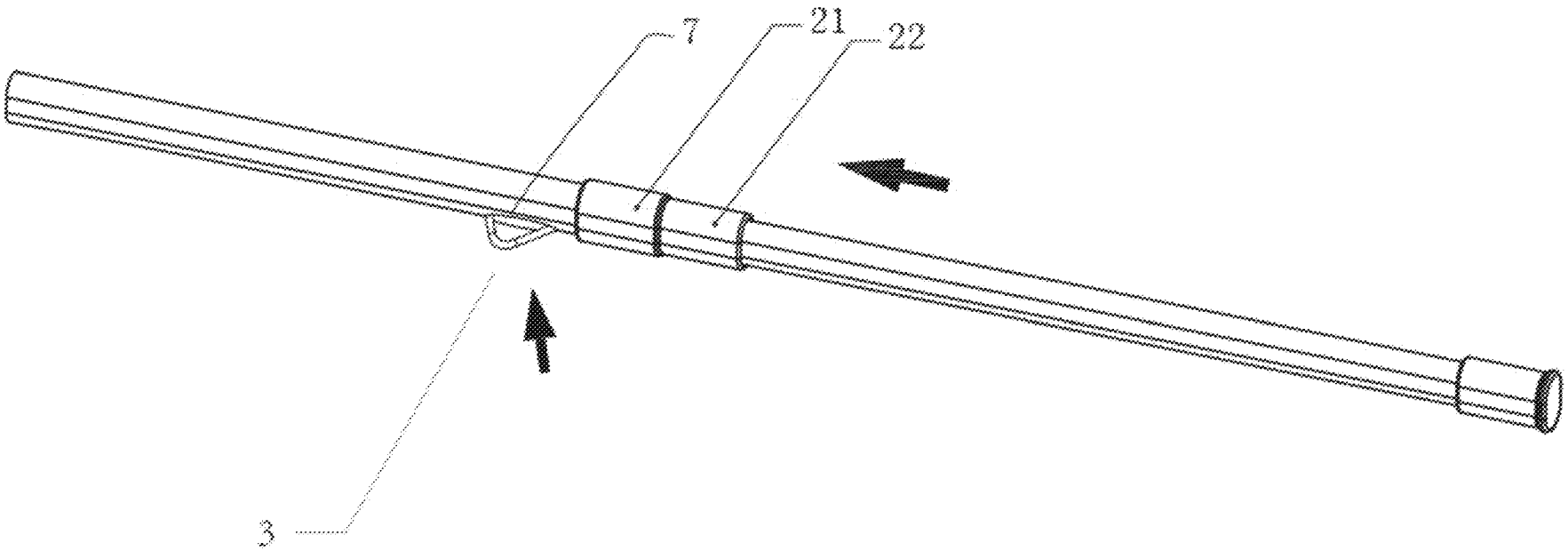
FIG. 2 is a schematic diagram showing a structure of the sunshade umbrella rib according to one embodiment of the present disclosure.
Figure 3:
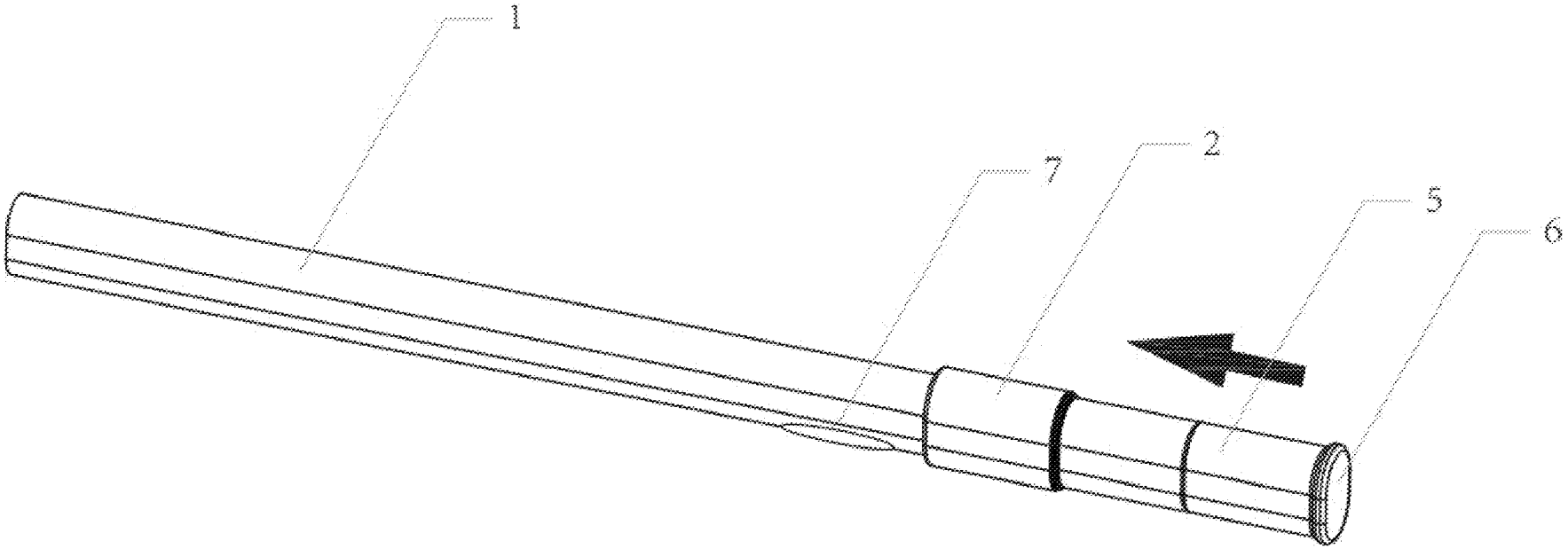
FIG. 3 is a schematic diagram showing the structure of the sunshade umbrella rib where the sunshade umbrella rib is in use.
Figure 4:
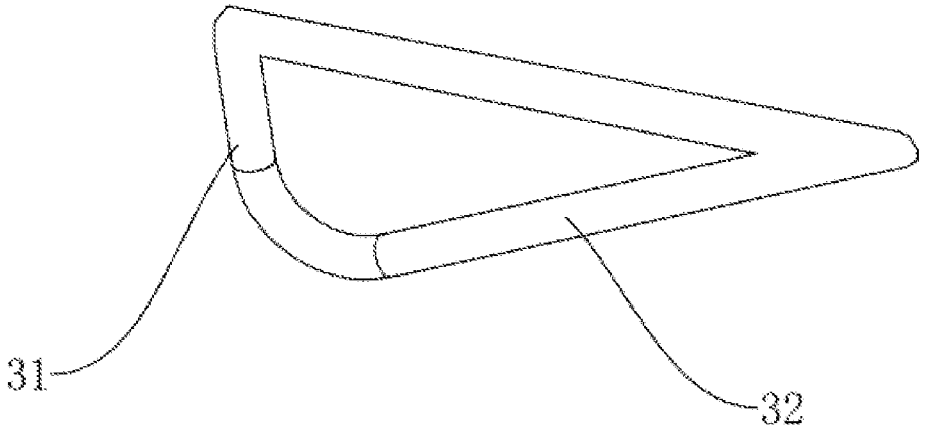
FIG. 4 is a schematic diagram showing a structure of an elastic piece according to one embodiment of the present disclosure.
Figure 5:
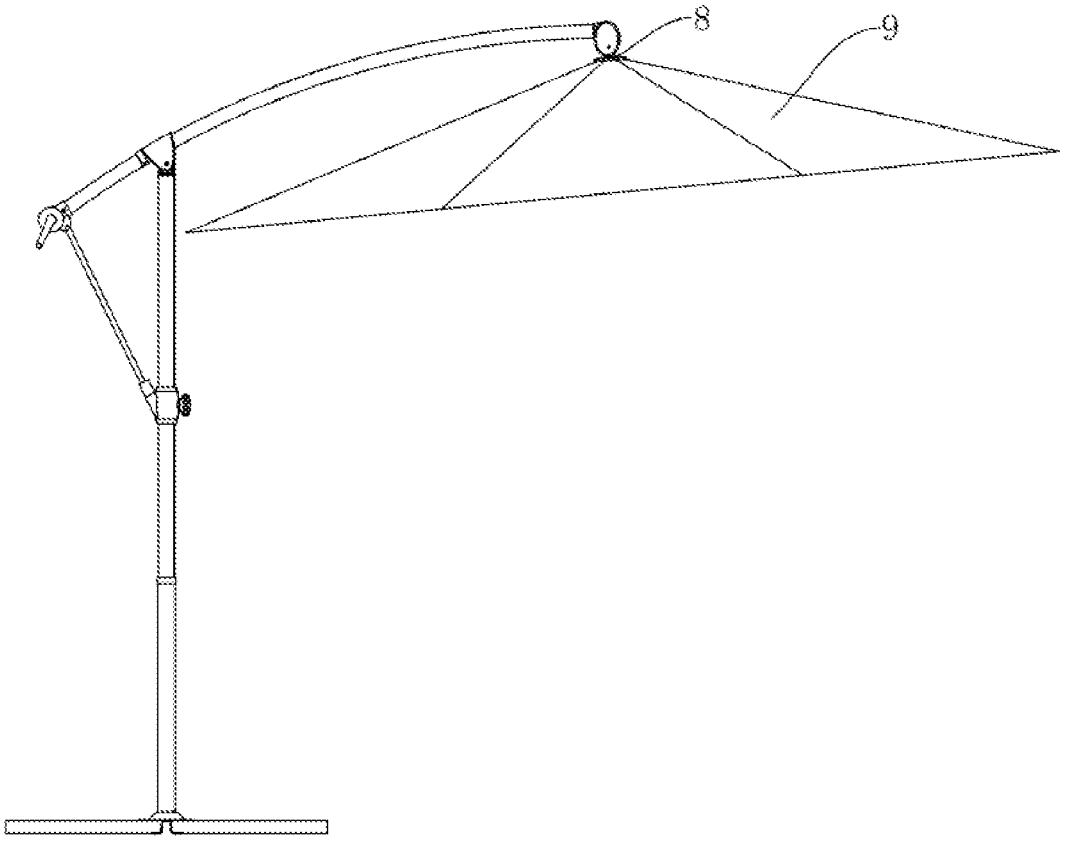
FIG. 5 is a schematic diagram showing a structure of the sunshade umbrella rib where the sunshade umbrella rib is in a configuration of use.

As shown in FIG. 1-5, the present disclosure provides a detachable sunshade umbrella rib including a first umbrella rib 1 and a second umbrella rib 4. The first umbrella rib 1 is connected with the second umbrella rib 4 by a sleeve connecting mechanism. The sleeve connecting mechanism comprises a clamping hole 7, a sheath 2, and an elastic piece 3. The sheath 2 is disposed on one end of the first umbrella rib 1. Another end of the first umbrella rib 1 is fixedly connected with an umbrella plate 8. The clamping hole is on the first umbrella rib 1 and is located on one side of the sheath 2. The elastic piece 3 is disposed on the second umbrella rib 4. The second umbrella rib 4 is sleeved into the first umbrella rib 1. The second umbrella rib 4 is fixed with the first umbrella rib 1 through the sheath 2, the elastic piece 3, and the clamping hole 7. One end of the second umbrella rib 4 inserts into the first umbrella rib 1. Another end of the second umbrella rib 4 is sleeved and fixed with a plug 5. One end of the plug 5 of the second umbrella rib 4 is fixed with an umbrella cloth 9. The plug 5 is configured to open the umbrella cloth 9 when in use.

The sheath 2 comprises a first sub sheath 21 and a second sub sheath 22. The first sub sheath 21 and the second sub sheath 22 are integrally formed. An aperture of the first sub sheath 21 is greater than an aperture of the second sub sheath 22. An inner surface of the first sub sheath 21 of the sheath 2 is frictionally connected with an outer surface of the first umbrella rib 1. An inner surface of second sub sheath 22 of the sheath 2 is slidingly sleeved with an outer surface of the second umbrella rib 4. An outer diameter of the second sub sheath 22 of the sheath 2 is same as an outer diameter of the plug 5. With such a compact arrangement, the first umbrella rib 1, the second umbrella rib 4 and the sheath 2 are inserted into each other without being too loose and affecting the use of the sunshade umbrella rib.

The elastic piece 3 has a rounded structure. A first side length 31 of one side of the elastic piece 3 that first runs through the first umbrella rib 1 is less than a second side length 32 of another side of the elastic piece 3 that runs through the first umbrella rib later. The elastic piece 3 is selected from a shrapnel or an elastic steel wire. An end face of the plug 5 extends and protrudes along the outer diameter of the plug 5 to from a seat ring 6.

When packing and transporting, the second umbrella rib 4 is separated from the first umbrella rib 1. The second umbrella rib 4 does not need to be fixed with the umbrella cloth when transporting, so that it can be placed more freely and more sunshade umbrella ribs are packed. When in use, the second umbrella rib 4 is directly inserted into the first umbrella rib, and the elastic piece 3 is clamped with the clamping hole 7. At this time, the sunshade umbrella rib of the present disclosure plays a role as a non-detachable sunshade umbrella rib. When in use, the second umbrella rib 4 can be directly inserted into a bottom portion of the first umbrella rib 1, and the plug 5 is used as a barrier to prevent the second umbrella rib 4 from being completely inserted into the first rib 1 and not easily removed. The seat ring 6 of the plug 5 helps to pull out the second umbrella rib 4.

The structures of the above embodiments are only explanations of the present disclosure and it is not a limitation to the present disclosure. After reading this specification, those skilled in the art can make modifications according to these embodiments without creative contribution, which should all fall within the scope of the present disclosure.

What is claimed is:

1. A detachable sunshade umbrella rib, comprising:

a first umbrella rib; and a second umbrella rib;

wherein the first umbrella rib is connected with the second umbrella rib by a sleeve connecting mechanism; the sleeve connecting mechanism comprises a clamping hole, a sheath, and an elastic piece; the sheath is disposed on one end of the first umbrella rib; the clamping hole is on the first umbrella rib and is located on one side of the sheath; the elastic piece is disposed on the second umbrella rib; the second umbrella rib is sleeved into the first umbrella rib; the second umbrella rib is fixed with the first umbrella rib through the sheath, the elastic piece, and the clamping hole;

wherein one end of the second umbrella rib inserts into the first umbrella rib; another end of the second umbrella rib is sleeved and fixed with a plug;

wherein the sheath comprises a first sub sheath and a second sub sheath, an outer diameter of the second sub sheath of the sheath is same as an outer diameter of the plug.

2. The detachable sunshade umbrella rib according to claim 1, wherein the elastic piece has a rounded structure; a first side length of one side of the elastic piece that first runs through the first umbrella rib is less than a second side length of another side of the elastic piece that runs through the first umbrella rib later.

3. The detachable sunshade umbrella rib according to claim 1, wherein another end of the first umbrella rib is fixedly connected with an umbrella plate; one end of the plug of the second umbrella rib is fixed with an umbrella cloth.

4. The detachable sunshade umbrella rib according to claim 1, the first sub sheath and the second sub sheath are integrally formed; and an aperture of the first sub sheath is greater than an aperture of the second sub sheath; an inner surface of the first sub sheath of the sheath is frictionally connected with an outer surface of the first umbrella rib; an inner surface of second sub sheath of the sheath is slidingly sleeved with an outer surface of the second umbrella rib.

5. The detachable sunshade umbrella rib according to claim 1, wherein an end face of the plug extends and protrudes along the outer diameter of the plug to from a seat ring.

* * * * *